US007697874B2

(12) United States Patent
Izutani et al.

(10) Patent No.: US 7,697,874 B2
(45) Date of Patent: Apr. 13, 2010

(54) DEVELOPER SUPPLY ROLLER AND IMAGE FORMING APPARATUS

(75) Inventors: Akira Izutani, Takatsuki (JP); Minoru Nakamura, Takarazuka (JP)

(73) Assignee: Ricoh Company, Ltd., Tokyo (JP)

( * ) Notice: Subject to any disclaimer, the term of this patent is extended or adjusted under 35 U.S.C. 154(b) by 195 days.

(21) Appl. No.: 12/046,952

(22) Filed: Mar. 12, 2008

(65) Prior Publication Data

US 2008/0232864 A1 Sep. 25, 2008

(30) Foreign Application Priority Data

Mar. 19, 2007 (JP) ..... 2007-071533
Jul. 6, 2007 (JP) ..... 2007-178590
Aug. 23, 2007 (JP) ..... 2007-217082

(51) Int. Cl.
*G03G 15/08* (2006.01)

(52) U.S. Cl. ..... 399/281

(58) Field of Classification Search ..... 399/272, 399/279, 281, 286
See application file for complete search history.

(56) References Cited

U.S. PATENT DOCUMENTS 6,952,550 B2 * 10/2005 Ohkuwa et al. ..... 399/281
7,206,539 B2 * 4/2007 Kawahara et al. ..... 399/281
2007/0207399 A1 3/2007 Kadota et al.

FOREIGN PATENT DOCUMENTS

| | | |
|---|---|---|
| JP | 2003-162142 | 6/2003 |
| JP | 2005-233229 | 9/2005 |
| JP | 2005-234405 | 9/2005 |
| JP | 2005-338253 | 12/2005 |
| JP | 2006-154537 | 6/2006 |
| JP | 2006-184602 | 7/2006 |

* cited by examiner

*Primary Examiner*—Hoang Ngo
(74) *Attorney, Agent, or Firm*—Oblon, Spivak, McClelland, Maier & Neustadt, L.L.P.

(57) ABSTRACT

To provide a developer supply roller including: a shaft core; and an elastic layer over the shaft core, wherein the elastic layer is composed of at least a first elastic layer and a second elastic layer, the first elastic layer and second elastic layer made of elastic bodies with different moduli of elasticity, the first layer being an outermost layer of the supply roller, and wherein the relationships $0\% \leqq k1 \leqq 20\%$ and $20\% \leqq k2 \leqq 70\%$ are satisfied, where k1 is the modulus of repulsion elasticity of the first elastic layer and k2 is the modulus of repulsion elasticity (%) of the second elastic layer.

7 Claims, 7 Drawing Sheets

DEVELOPER SUPPLY ROLLER AND IMAGE FORMING APPARATUS

BACKGROUND OF THE INVENTION

1. Field of the Invention

The present invention relates to a developer supply roller (hereinafter, sometimes referred to as "toner supply roller" or "supply roller") in a developing device used for electrophotographic image formation process and to an image forming apparatus using a non-magnetic one component developer and the supply roller.

2. Description of the Related Art

Various types of elastic rubber rollers are used in electrophotographic copiers and printers. For example, a toner supply roller for supplying toner to a developing roller is used in a developing device in which a latent electrostatic image formed on a photoconductor is developed. A given amount of toner is supplied from the toner supply roller to the developing roller, and a latent electrostatic image is developed by the toner deposited on the surface of the developing roller. To achieve stable image formation, the toner supply roller plays an extremely important role; for example, poor supply of toner from the toner supply roller to the developing roller will result in the formation of blurred copies with reduced image density. Further, the supply roller not only functions to supply toner to the developing roller, but also to recover toner on the developing roller, which has not been subjected to development. If toner on the developing roller is not recovered but remains on the developing roller for a prolonged period of time, the toner particles are rubbed against each other many times at a developer regulation portion and, as a result, the toner shows an abnormal level of charge amount. Moreover, the toner is degraded due to stress caused by being rubbed and adversely affects image quality. Therefore, it is now strongly demanded to develop a toner supply roller, which can always supply a fixed quantity of toner and can stably recover the toner on a developing roller.

In recent years, smaller image forming apparatus and higher printing speed have been demanded. As the apparatus becomes smaller, there is a necessity for miniaturizing a developing unit, which in turn results in a necessity for manufacturing a developing roller and a supply roller smaller in terms of their diameter. Further, it is necessary to increase the rotational speed of each roller when increasing the printing speed. Accordingly, rollers with smaller diameters require increased rotational speed. In this case, toner charge amount and toner transfer efficiency decreases.

Further, in association with the miniaturization of apparatus and the necessity for greater printing speed, the supply roller is required to be made smaller in diameter and rotated at high speed. In order to retain toner chargeability and transfer efficiency and to attain a stable image output with such smaller rollers, it is contemplated to increase the penetrating amount (indentation amount) of the supply roller with respect to the developing roller. When the indentation amount the supply roller to the developing roller is increased, toner is more efficiently scraped by the developing roller. However, this results in increased frictional force between the rollers and the rotational torque of each roller increases. Moreover, the rollers with small diameters have low heat capacity and generate heat due to friction, whereby the toner is heated to elevated temperatures and is thereby firmly attached to the developing roller or regulation blade, resulting in unstable image formation. Furthermore, increasing the indentation amount of the supply roller into the developing roller gives undue stress to toner, leading to degradation of toner stored in the developing unit. Thus, there is a fear that image quality decreases when the toner is used for a prolonged period of time.

On the other hand, a method has been contemplated for decreasing the modulus of repulsion elasticity of the supply roller in order to reduce the rotational torque of the supply roller. A decrease in the modulus of repulsion elasticity of the supply roller makes it possible to reduce the rotational torque. Low repulsion foams are excellent in impact absorption and vibration absorption. Particularly, where such foams are employed as a material of a supply roller and a cleaning roller, they are in contact with a developing roller and photoconductor at a uniform contact pressure and thereby local stresses are relieved. Thus, excellent toner scraping property can be expected at low contact pressures. However, foams are less resilient after application of strain and thus it is difficult to stably form a nip between the rollers. Foams are particularly difficult to employ as a high-speed rotating body. A simple decrease in the modulus of repulsion elasticity of the supply roller will make a nip portion unstable, thereby adversely affecting the toner chargeability and transfer efficiency and cause image unevenness.

In an attempt to solve the foregoing problems Japanese Patent Application Laid-Open (JP-A) No. 2006-184602 has proposed a toner supply roller composed of a metal shaft, a first layer and a second layer, wherein the first layer (shaft side) is greater than the second layer (surface side) in average pore diameter. However, considering the fact that foams with larger average pore diameters have smaller modulus of elasticity, this proposal will result in the formation of unstable nip portion and unstable toner supply by a supply roller.

Further, JP-A No. 2006-154537 has proposed a supply roller in which an appropriate modulus of repulsion elasticity of the supply roller measured in accordance with JIS K6400 is in a range of 30% to 60%. With this proposal however, it is still difficult to make the contact pressure of the supply roller against the developing roller and photoconductor uniform for relieved local stresses, to keep the nip portion stable, and to provide stable toner chargeability and excellent toner efficiency at the same time.

Neither of the above Patent Literatures can fully solve the above problems, i.e., increased frictional resistance with an increase in the indentation amounts of the rollers, increased rotational torque, accelerated toner degradation, and heat generation from the rollers. On the other hand, where the elasticity moduli of the developing roller and supply roller are reduced, the rotational torque can be reduced. However, this raises another problem of unstable nip portion and unstable toner supply by the supply roller, leading to poor toner charge amount and poor toner transfer efficiency that may cause image unevenness.

BRIEF SUMMARY OF THE INVENTION

An object of the present invention is to provide a developer supply roller and an image forming apparatus using the supply roller in which the developer supply roller is composed of at least two layers with different repulsion properties, wherein the first elastic layer (uppermost layer) that contacts the developing roller is made of low repulsion material, and the second elastic layer is made of high repulsion elastic body, so that it is made possible to attain at the same time excellent toner scraping property and the reduction and stability of torque.

The above-described problems will be solved by the following means. Specifically, <1> A developer supply roller including: a shaft core; and an elastic layer over the shaft core, wherein the elastic layer is composed of at least a first elastic layer and a second elastic layer, the first elastic layer and second elastic layer made of elastic bodies with different moduli of elasticity, the first layer being an outermost layer of the supply roller, and wherein the relationships $0\% \leqq k1 \leqq 20\%$ and $20\% \leqq k2 \leqq 70\%$ are satisfied, where k1 is the modulus of repulsion elasticity of the first elastic layer and k2 is the modulus of repulsion elasticity (%) of the second elastic layer.

<2> The developer supply roller according to <1>, wherein the first elastic layer is made of foam.

<3> The developer supply roller according to one of <1> and <2>, wherein the first elastic layer is 0.2 mm to 2.0 mm in thickness.

<4> An image forming apparatus including: a latent image bearing member; a charging unit configured to charging a surface of the latent image bearing member; an exposure unit configured to exposing the surface of the latent image bearing member to form a latent electrostatic image thereon; and a developing unit that comprises a toner container portion structured so as to supply a new toner, a developer supply roller and a developing roller, the supply roller being in contact with the developing roller, the developing unit configured to retain the toner contained in the toner container portion on a surface of the supply roller and rotate the supply roller so as to transfer the toner onto the developing roller to thereby form a toner thin layer, wherein the developer supply roller is the developer supply roller according to any one of <1> to <3>, and wherein the thickness t (mm) of the first elastic layer of the developer supply roller is in a range of $0.2\ \text{mm} \leqq t \leqq 2.0$ mm, and the indentation amount P (mm) of the supply roller into the developing roller satisfies the relationship $0.2 \leqq P/t \leqq 1$.

<5> The image forming apparatus according to <4>, wherein the developing roller and the developer supply roller are rotated in opposite directions at a nip portion.

<6> The image forming apparatus according to one of <4> and <5>, wherein the developer supply roller is 6 mm to 12 mm in outer diameter.

<7> The image forming apparatus according to any one of <4> to <6>, wherein the toner is a non-magnetic one component developing toner.

The developer supply roller of the present invention features that the relationships $0\% \leqq k1 \leqq 20\%$ and $20\% \leqq k2 \leqq 70\%$ are satisfied, where k1 is the modulus of repulsion elasticity of the first elastic layer (outermost layer) and k2 is the modulus of repulsion elasticity (%) of the second and subsequent elastic layers. Thus, when the supply roller is made smaller in diameter and rotated at high speeds in an small image forming apparatus, heat generation inside the developing unit is suppressed and thereby excellent images can be produced without deterioration in image quality even after a prolonged printing operation. Low repulsion foams are excellent in impact absorption and vibration absorption. Particularly, where such foams are employed as a material of a supply roller and a cleaning roller, they are in contact with a developing roller and photoconductor at a uniform contact pressure and thereby local stresses are relieved. Thus, excellent toner scraping property can be expected at low contact pressures. However, foams are less resilient after application of strain and thus it is difficult to stably form a nip between the rollers. Foams are particularly difficult to employ as a high-speed rotating body.

The present invention can effectively solve the aforesaid problems by employing a supply roller composed of at least two layers with different repulsion properties, wherein the first elastic layer (uppermost layer) is made of low repulsion material, and the second elastic layer is made of high repulsion elastic body.

DETAILED DESCRIPTION OF THE INVENTION

Figure 1:
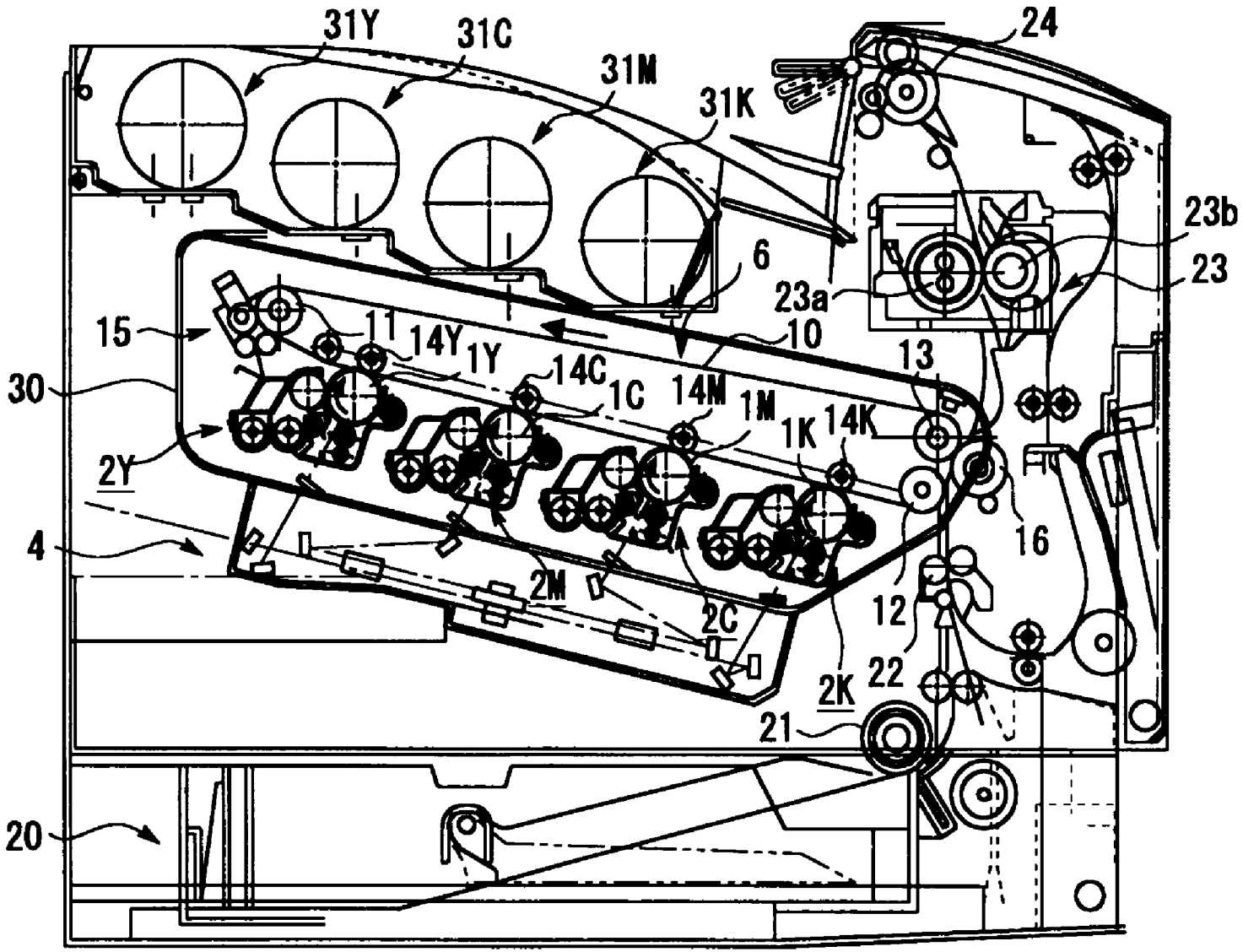
FIG. 1 is a schematic diagram showing one example of constitution of an image forming apparatus according to an embodiment of the present invention.

Developer Supply Roller and Image Forming Apparatus

The developer supply roller of the present invention is provided at least with a shaft core and an elastic layer over the shaft core, with the elastic layer composed of at least two elastic layers made of elastic bodies with different elasticity moduli, wherein the relationships $0\% \leqq k1 \leqq 20\%$ and $20\% \leqq k2 \leqq 70\%$ are satisfied, where k1 is the modulus of repulsion elasticity of the first elastic layer (outermost layer) and k2 is the modulus of repulsion elasticity (%) of the second and subsequent elastic layers.

The developer supply roller of the present invention is used as a developing unit in the image forming apparatus of the present invention.

Hereinafter, a description is given in detail for the developer supply roller and the image forming apparatus of the present invention.

The image forming apparatus of the present invention includes at least a latent image bearing member (hereinafter, sometimes referred to as "electrophotographic photoconductor" or "photoconductor"), a charging unit, an exposure unit and a developing unit, additionally provided with a transfer unit, a fixing unit, and other units appropriately selected whenever necessary, for example, a cleaning unit, a discharging unit, a recycle unit and a control unit.

The developing unit is a unit provided with a toner container portion using toner to develop a latent electrostatic image formed on a latent image bearing member, thereby forming a visible image and structured so as to fill new toner from outside, a developer supply roller and a developing roller, in which the supply roller is in contact with the developing roller, toner inside the toner container portion is retained on the surface of the supply roller, and the supply roller is rotated to bring the toner up on the developing roller, thereby forming a toner thin layer.

The above-described developer supply roller is the developer supply roller of the present invention, and the thickness t (mm) of the first elastic layer of the developer supply roller is in a range of 0.2 mm to 2.0 mm, and the indentation amount P (mm) of the supply roller into the developing roller satisfies the relationship $0.2 \leqq P/t \leqq 1$.

The thickness t (mm) of the first elastic layer of the developer supply roller is preferably in a range of 0.2 mm to 2.0 mm. Where the thickness t is less than 0.2 mm, a greater rotational torque of rotating the supply roller may result in decreased durability or increased cost of an apparatus. Where it exceeds 0.2 mm, the supply roller is made larger in outer diameter, thereby an apparatus is not miniaturized. As a result, a necessity for using the low repulsion/elastic roller of the present invention may be eliminated.

Where the value of P/t is less than 0.2, it may result in significant reduction in the toner supply function and furthermore in toner recovery function from the developing roller. Where it exceeds 1, a greater rotational torque of rotating the supply roller may result in decreased durability or increased costs.

In the present invention, it is preferable that the developing roller and the developer supply roller be rotated in opposite directions (counter directions) at the nip portion. With this configuration, the rotational torque between the developing roller and supply roller increases. In this instance, the use of the supply roller of the present invention offers such an advantage that increases in the torque for rotating the rollers in the counter directions can be reduced.

The developer supply roller is preferably in a range of 6 mm to 12 mm in outer diameter. Where the outer diameter is less than 6 mm, the shaft core may be easily bent to cause an irregular contact with the developing roller, thereby causing the occurrence of image noise. If it exceeds 12 mm, it is not desirable in view of apparatus miniaturization.

A non-magnetic one component image forming process is preferable in view of apparatus miniaturization, and as the toner, preferably used is a non-magnetic one component developing toner appropriate for the non-magnetic one component image forming process.

Here, a description is given for a basic constitution of the image forming apparatus (printer) of the present embodiment with reference to the drawings.

FIG. 1 is a schematic diagram showing a constitution of the image forming apparatus according to an embodiment of the present invention. In this instance, a description is given for one embodiment, which is used in an electrophotographic image forming apparatus. The image forming apparatus is to form color images by using four different colors of toner, that is, yellow (hereinafter, abbreviated as "Y"), cyan (hereinafter, abbreviated as "C"), magenta (hereinafter, abbreviated as "M") and black (hereinafter, abbreviated as "K").

First, a description is given for a basic constitution of the image forming apparatus ("tandem-type image forming apparatus") having a plurality of latent image bearing members in which a plurality of these latent image bearing members are arranged in a line in the moving direction of a surface moving member. The image forming apparatus is provided with four photoconductors, 1Y, 1C, 1M and 1K as latent image bearing members. In addition, this example mentions a drum-shaped photoconductor but a belt-shaped photoconductor may be also adopted. Each of the photoconductors, 1Y, 1C, 1M and 1K, is rotated and driven in a direction given in the arrow of the drawing while in contact with an intermediate transfer belt 10, which is the surface moving member. Each of the photoconductors, 1Y, 1C, 1M and 1K, is rotated and driven in a direction given in the arrow of the drawing while in contact with the intermediate transfer belt 10. Each of the photoconductors 1Y, 1C, 1M, and 1K may be composed of a photosensitive layer formed on a relatively thin cylindrical conductive base and a protective layer formed on the photosensitive layer. Further, an intermediate layer may be formed between the photosensitive layer and the protective layer.

Figure 2:
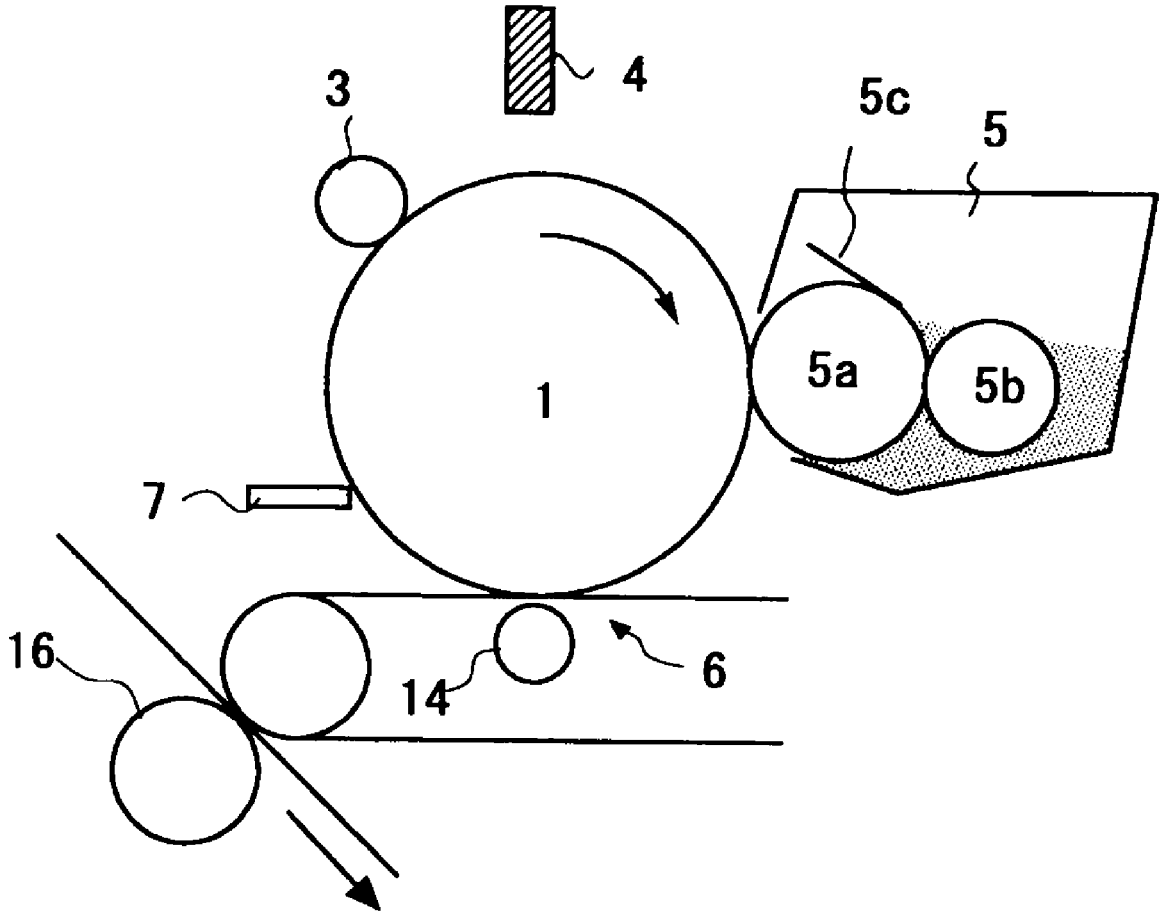
FIG. 2 is a schematic diagram showing a constitution of an image forming portion at which a photoconductor is disposed.

FIG. 2 is a schematic diagram showing a constitution of an image forming portion 2 at which photoconductors are disposed. In addition, since all the photoconductors, 1Y, 1C, 1M and 1K, at each of the image forming portions, 2Y, 2C, 2M and 2K, are constituted in a similar manner, only one of the image forming portions 2 is illustrated and symbols for color identification, Y, C, M, K, are omitted for illustration. A charging device 3 as a charging unit, a developing device 5 as a developing unit, a transfer device 6 for transferring a toner image on the photoconductor 1 to a recording medium or an intermediate transfer body 10 and a cleaning device 7 for removing toner remaining on the photoconductor 1 are arranged in the thus described order along the surface moving direction thereof around the photoconductor 1. A space is secured between the charging device 3 and the developing device 5 in such a manner that light emitted from an exposure device 4 as a latent image forming unit can pass through to the photoconductor 1.

The charging device 3 charges negatively a surface of the photoconductor 1. The charging device 3 of the present embodiment is provided with a charging roller as a charge member, which conducts charging treatment by the so-called contact-charging method. In other words, the charging device 3 allows the charging roller to be in contact with or adjacent to the surface of the photoconductor 1, thereby applying negative bias to the charging roller to charge the surface of the photoconductor 1. Direct-current charge bias is applied to the charging roller so that the surface potential of the photoconductor 1 is set to be −500V.

In addition, alternating-current bias is superimposed on direct-current bias and the thus obtained bias is used as charge bias. Further, the charging device 3 may be provided with a cleaning brush for cleaning the surface of the charging roller. Still further, a thin film may be wound around the both ends of the charging roller as the charging device 3 and placed so as to be in contact with the surface of the photoconductor 1. With this configuration, the surface of the charging roller is in close proximity to the surface of the photoconductor 1, with only the thickness of the film being spaced away. Therefore, the charge bias applied to the charging roller causes electric discharge between the surface of the charging roller and the surface of the photoconductor 1, and the surface of the photoconductor 1 is charged by the discharge.

A latent electrostatic image corresponding to each color after exposure by an exposure device 4 is formed on the surface of the thus charged photoconductor 1. The exposure device 4 writes the latent electrostatic image corresponding to each color with respect to the photoconductor 1 on the basis of image information corresponding to each color. In addition, the exposure device 4 of the present embodiment is based on a laser process but other processes made up of an LED array and an image forming unit can also be adopted.

Toner filled into the developing device 5 from toner bottles 31Y, 31C, 31M and 31K, is conveyed by a supply roller 5*b* and carried on a developing roller 5*a*. The developing roller 5*a* is conveyed to a developing area, which is opposed to the photoconductor 1. Here, the developing roller 5*a* is surface-moved to the same direction at a linear velocity faster than the surface of the photoconductor 1 at an area opposed to the photoconductor 1 (hereinafter, referred to as "developing area"). Then, toner is supplied to the surface of the photoconductor 1, while toner on the developing roller 5*a* slidingly rubs the surface of the photoconductor 1. At this time, −300V developing bias is applied to the developing roller 5*a* from a power supply (not illustrated), by which a developing electrical field is formed at the developing area. Then, an electrostatic force moving toward the latent electrostatic image is to act on the toner on the developing roller 5*a* between a latent electrostatic image on the photoconductor 1 and the developing roller 5*a*. Thereby, the toner on the developing roller 5*a* is adhered to the latent electrostatic image on the photoconductor 1. Upon adhesion, the latent electrostatic image on the photoconductor 1 is developed into a toner image corresponding to each color.

The intermediate transfer belt 10 of the transfer device 6 is stretched between three support rollers 11, 12, and 13 and constituted so as to move endlessly toward a direction given in the arrow of the drawing. A toner image on each of the photoconductors, 1Y, 1C, 1M and 1K is transferred on the intermediate transfer belt 10 by an electrostatic transfer process so as to overlap each other. The electrostatic transfer process is also available as a constitution in which a transfer charger is used. In this instance, such a constitution is adopted that a transfer roller 14 producing a smaller quantity of transfer dust is used. More specifically, primary transfer rollers, 14Y, 14C, 14M and 14K are arranged as the respective transfer devices 6 at the back face of a part of the intermediate transfer belt 10 in contact with each of the photoconductors, 1Y, 1C, 1M and 1K. In this instance, a primary transfer nip portion is formed by a part of the intermediate transfer belt 10 pressed by each of the primary transfer rollers, 14Y, 14C, 14M and 14K and each of the photoconductors, 1Y, 1C, 1M and 1K. Then, in transferring a toner image on each of the photoconductors, 1Y, 1C, 1M, 1K to the intermediate transfer belt 10, positive bias is applied to each of the primary transfer rollers 14. Thereby, a transfer electrical field is formed at each of the primary transfer nip portions, and the toner image on each of the photoconductors 1Y, 1C, 1M and 1K is electrostatically adhered on the intermediate transfer belt 10 and transferred.

A belt cleaning device 15 for removing toner remaining on the surface thereof is installed around the intermediate transfer belt 10. The belt cleaning device 15 is constituted so as to recover unnecessary toner adhered on the surface of the intermediate transfer belt 10 by using a fur brush and a cleaning blade. In addition, the thus recovered unnecessary toner is conveyed by a conveying unit (not illustrated) from the belt cleaning device 15 to a discharged toner tank (not illustrated).

A secondary transfer roller 16 is arranged in contact with a part of the intermediate transfer belt 10 stretched between support rollers 13. A secondary transfer nip portion is formed at a space between the intermediate transfer belt 10 and the secondary transfer roller 16, and a transfer sheet as a recording member is to be sent into the space at a predetermined timing. The transfer sheet is accommodated inside a feed cassette 20 below in a drawing illustrating the exposure device 4 and conveyed up to the secondary transfer nip portion by a supply roller 21, a pair of resist rollers 22 and the like. Then, toner images overlapped on the intermediate transfer belt 10 are all together transferred on the transfer sheet at the secondary transfer nip portion. At the secondary transfer, positive bias is applied to the secondary transfer roller 16, by which a transfer electrical field is formed to transfer the toner images on the intermediate transfer belt 10 to the transfer sheet.

A heat fixing device 23 is arranged as a fixing unit at the secondary transfer nip portion downstream from the conveying direction of transfer sheets. The heat fixing device 23 is provided with a heating roller 23*a* having a built-in heater and a pressing roller 23*b* for applying pressure. A transfer sheet, which has passed through the secondary transfer nip portion, is caught between these rollers and given heat and pressure. Thereby, toner on the transfer sheet is melted and a toner image is fixed on the transfer sheet. The transfer sheet after being fixed is discharged by a discharging roller 24 on a discharge tray on the upper face of an apparatus.

The developing device 5 is provided with a developing roller 5*a* as a developer support, which is partially exposed from an opening of the casing thereof. Further, in this instance, used is a carrier-free one component developer. The developing device 5 accommodates therein toner corresponding to colors supplied from toner bottles 31Y, 31C, 31M and 31K, shown in FIG. 1. These toner bottles 31Y, 31C, 31M and 31K, are attached to or detached from the main body of the image forming apparatus so that they can be exchanged respectively as a single unit. As a result, when toner is used up, only the toner bottle concerned, 31Y, 31C, 31M or 31K, may be exchanged. Therefore, other bottles, which are still usable when the toner concerned is used up, can be used as they are, thus reducing the cost for the user.

Figure 3:
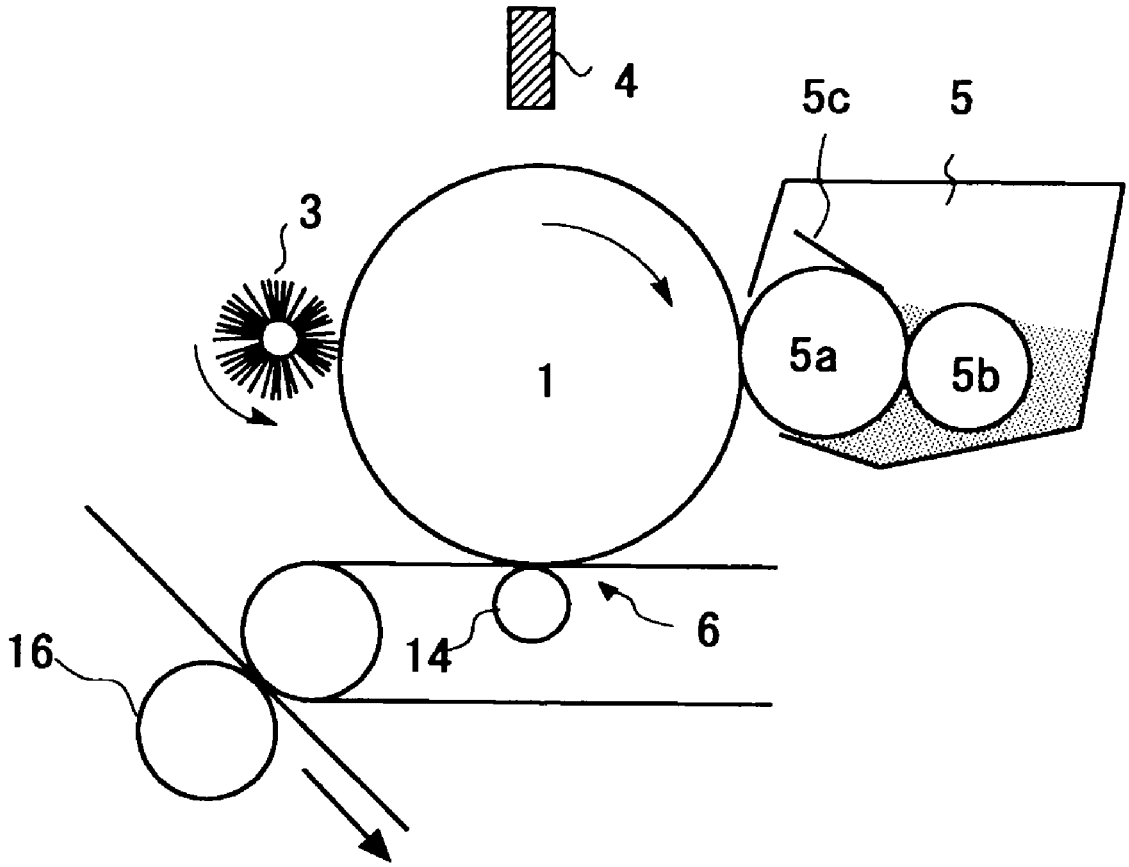
FIG. 3 is a schematic diagram showing a constitution of a cleaner-less type image forming portion.

FIG. 3 is a schematic diagram showing a constitution of a cleaner-less type image forming portion. In this instance, the cleaner-less process is required to recover remaining toner at a developing portion, and the thus recovered toner is mixed with toner not in use inside a developing unit and reused for development in a developing step.

In order to miniaturize an image forming apparatus, an electrophotographic process from which a cleaning device is removed has actively been considered. In the above process, remaining toner is recovered at the developing portion and mixed with toner not in use inside the developing device 5 and reused for development in the developing step. The image forming apparatus is provided with a developing device 5, as a recovering unit, which recovers and retains remaining toner on a photoconductor 1, that is, a latent image bearing member, after being transferred by a transfer unit from the photoconductor 1, and returns the thus retained remaining toner to the photoconductor 1. A developer (toner) at the toner filling portion inside a container of the developing device 5 is toner, which is filled inside the developing device 5 from the toner bottles 31Y, 31C, 31M and 31K, and conveyed to a nip portion of the developing roller 5*a*, while being stirred by a supply roller 5*b*.

Figure 4:
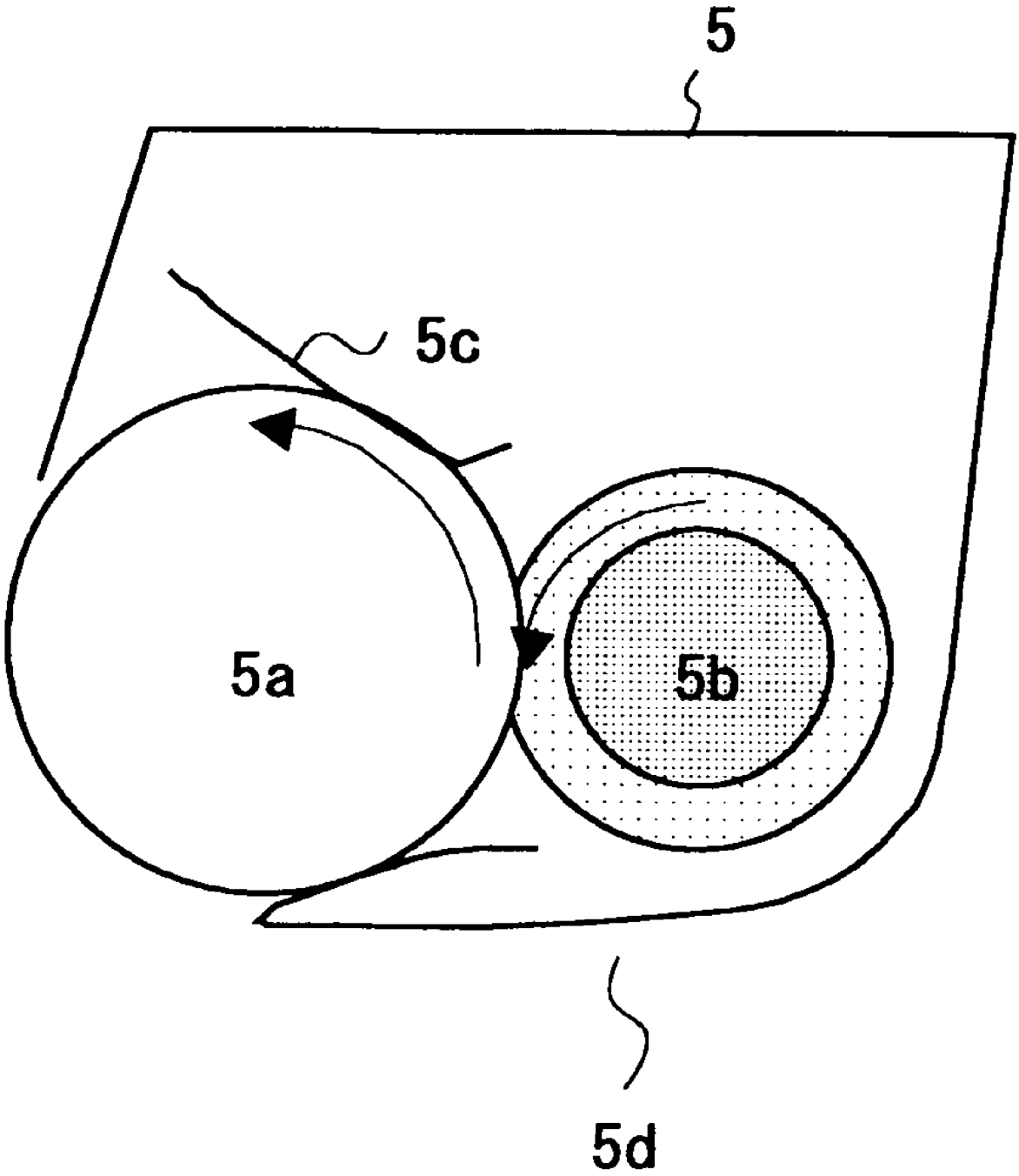
FIG. 4 is a schematic diagram showing one example of constitution of a developing device.

FIG. 4 is a schematic diagram showing a constitution of the developing device.

The developer (toner) at the toner filling portion is conveyed to the nip portion of the developing roller 5*a*, while being stirred by the supply roller 5*b*. Further, the amount of toner on the developing roller 5*a* is regulated by a regulating blade 5*c*, thereby forming a toner thin layer on the developing roller 5*a*. The toner is also slidingly rubbed between the supply roller 5*b* and the nip portion of the developing roller 5*a* and between the regulating blade 5*c* and the developing roller 5*a* and controlled so as to be appropriately charged. In a cleaner-less process particularly, in order to recover the transferred toner, the charge amount of the toner is significantly deviated from an appropriate value. Therefore, the toner recovered by the developing roller 5*a* must be sufficiently scraped and removed by the supply roller 5*b*.

The supply roller 5*b* and the developing roller 5*a* are rotated in opposite directions (counter rotations) at the nip portion. At this time, the difference in circumferential speed $\theta$ is preferably in a range of $0.6 \leqq \theta \leqq 2$. Where $\theta$ is less than 0.6, toner is rubbed with the developing roller 5*a* or the supply roller 5*b* with a lower force, thus making it difficult to increase the charge amount up to a desired level. Further, since toner recovered at a developing portion is reused in a cleaner-less system, it is necessary to re-adjust the charge amount of the recovered toner. In this respect, it is preferable to increase the rotational speed of the supply roller 5*b*.

Figure 5:
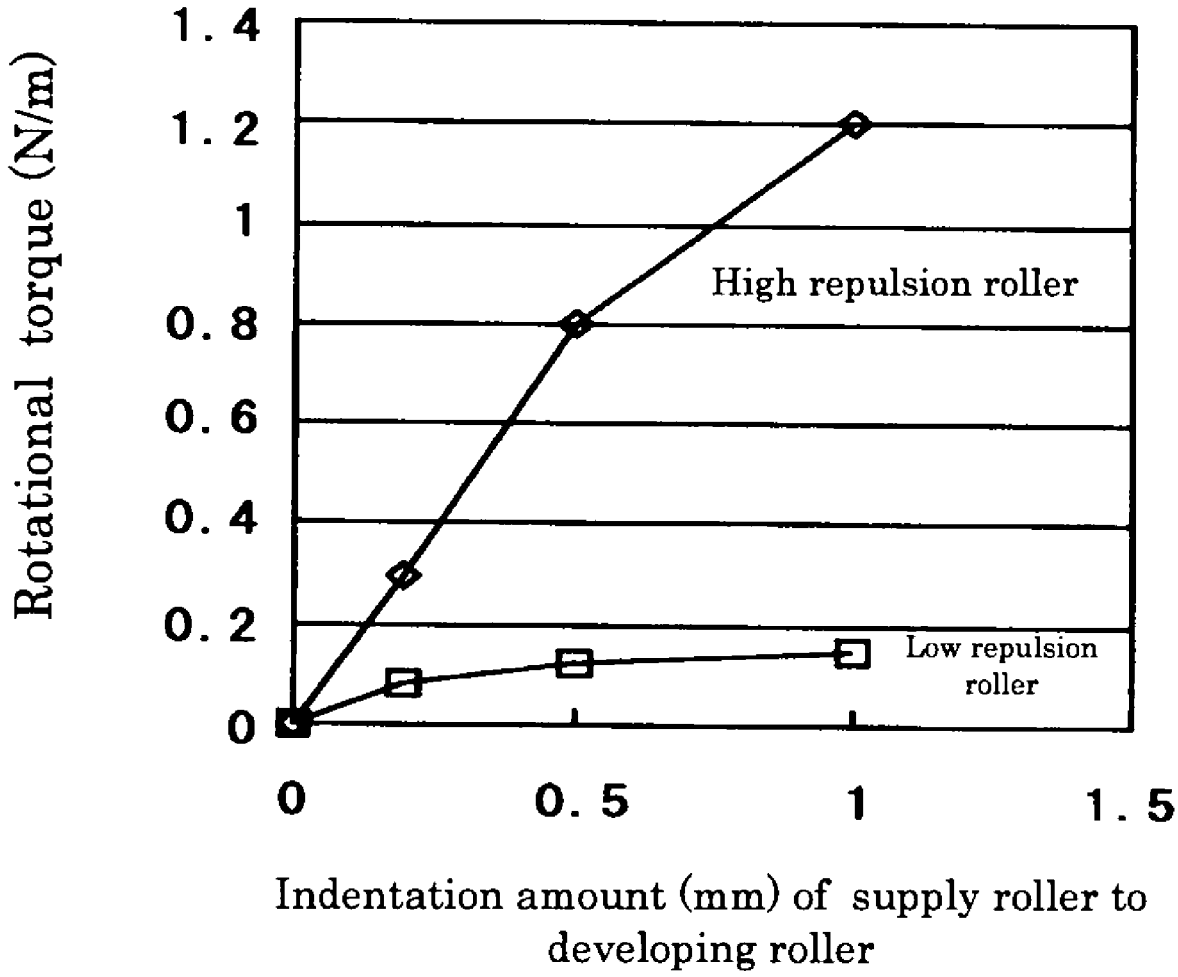
FIG. 5 is a graph showing a plot of indentation amount of the developer supply roller into a developing roller vs. torque.

FIG. 5 shows a plot of the indentation amount of a supply roller into a developing roller vs. torque. The horizontal axis indicates the indentation amount, whereas the longitudinal axis indicates rotational torque of the supply roller 5*b*. The rotational torque increases with increasing indentation amount. At this time it can be seen that the rotational torque decreases with decreasing modulus of repulsion elasticity of the supply roller 5*b*. It is clear that the torque can be decreased by using the supply roller 5*b* having a low modulus of repulsion elasticity.

Figure 6:
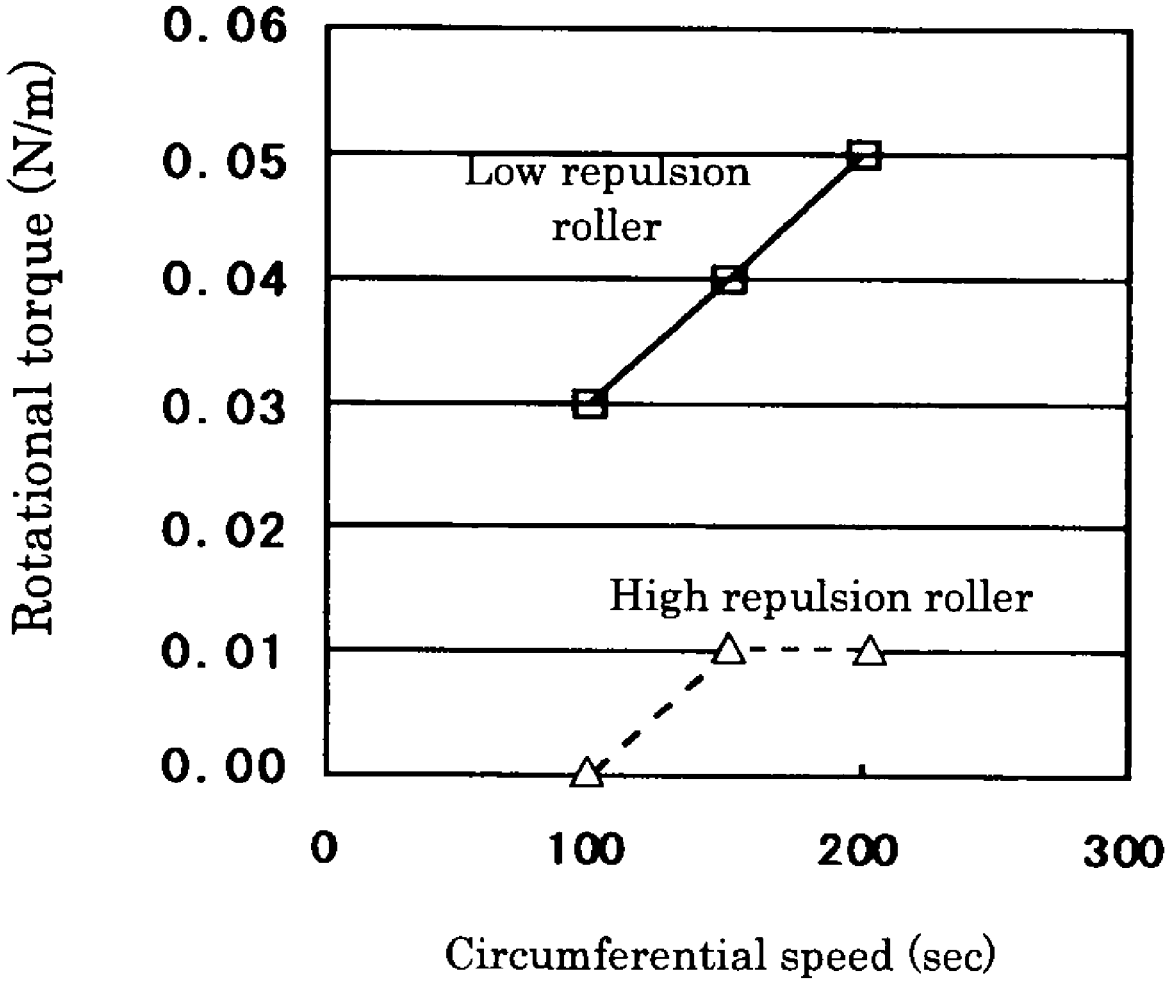
FIG. 6 is a graph showing the study result on the circumferential speed of a developer supply roller and the stability of rotational torque.

FIG. 6 shows a plot of the circumferential speed of a supply roller vs. rotational torque. It is apparent from FIG. 5 that the supply roller 5*b* with small repulsion shows a significant change in rotational torque with increasing circumferential speed. The variation in rotational torque is equivalent to the stability of a nip portion (both in thickness and width), which influences toner charge amount and transfer efficiency of toner on the developing roller 5*a*.

In view of improvement in charge amount of toner, it is preferable that bias be applied to the supply roller 5*b* and the developing roller 5*a*. The bias at this time is in a range from +200 to −200V.

A regulating blade 5*c*, which is a regulating member for regulating the quantity of toner on the developing roller 5*a*, may include a metal blade, a resin blade, a metal roller and a resin roller. A blade is preferably used in miniaturizing an apparatus.

The pressing force of the regulating blade 5*c* against the developing roller 5*a* is preferably in a range of 20 N/m to 100 N/m. Where the pressing force is low, the toner amount is insufficiently regulated or the toner is insufficiently charged. On the other hand, where the pressing force is high, stress is unduly given to toner or the developing roller 5*a*, causing deterioration of image on endurance. Further, bias in a range of −300V to +300V may be applied to the regulating blade 5*c* and developing roller 5*a*, whenever necessary.

Figure 7:
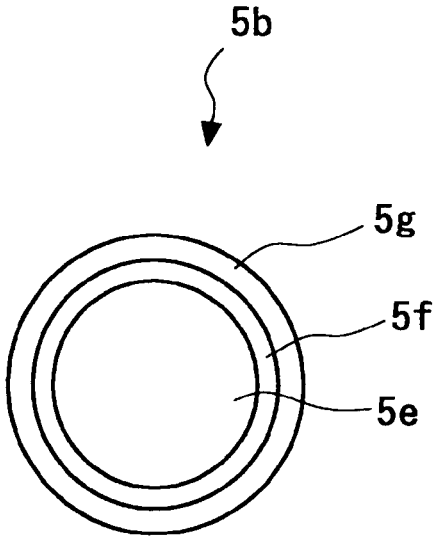
FIG. 7 is a schematic diagram showing one example of the developer supply roller of the present invention.

FIG. 7 is a schematic diagram of the supply roller which is a feature of the present invention. As shown in the drawing, the supply roller 5*b* of the present invention is constituted with a shaft core 5*e*, as a metal shaft, and at least a first elastic layer 5*g* and a second elastic layer 5*f*. FIG. 7 shows the two-layer structured supply roller 5*b*. However, the supply roller may be structured in multiple layers, as long as the relationship of $0\% \leqq k1 \leqq 0\%$ and $20\% \leqq k2 \leqq 70\%$ can be satisfied. where k1 is the modulus of repulsion elasticity of the first elastic layer 5*g* (outermost layer) and k2 is the modulus of repulsion elasticity (%) of second elastic layer 5*f* and subsequent elastic layers. Although there is no particular restriction on the diameter of the supply roller of the present invention, the supply roller 5*b* is preferably from 6 mm to 12 mm in outer diameter in view of apparatus miniaturization. The supply roller 5*b* is constituted with, in order from the roller surface, the first elastic layer 5*g*, second elastic layer 5*f* (and where necessary, subsequent elastic layer(s) under the second elastic layer 5*f*), and the shaft core 5*e*, wherein the relationships $0\% \leqq k1 \leqq 20\%$ and $20\% \leqq k2 \leqq 70\%$ are satisfied, where k1 is the modulus of repulsion elasticity of the first elastic layer 5*g*, and k2 is the modulus of repulsion elasticity (%) of the second elastic layer 5*f* and subsequent elastic layers (in other words, the elastic layer to the surface side is lower in modulus of repulsion elasticity). The thus constituted supply roller 5*b* may be prepared by selecting any appropriate foamed bodies from natural rubber, silicone rubber and urethane rubber, as long as they can satisfy the aforementioned relationships. An elastic foam roller is preferably used. There is a case where bias is applied between the supply roller 5*b* and the developing roller 5*a* in order to recover toner on the developing roller 5*a*. Where bias is applied to the supply roller 5*b*, the supply roller 5*b* is required to adjust the resistance before being used.

The supply roller 5*b* can be adjusted for the resistance by adding a resistance adjusting agent into a foam material, by coating directly a resistance adjusting agent on a foam, or by coating a resistance adjusting agent-added resin on an elastic foam.

Elastic Foam Roller

A method for manufacturing the supply roller 5*b* includes, for example, a method in which a shaft core 5*e* is placed inside a mold, and the rubber material composition is formed as foam inside the mold, thereby forming a sponge layer at the outer circumference of the shaft core 5*e* that is concentric with the shaft core 5*e*. In this instance, conditions such as molding pressure and molding temperature (temperature on the mold) may be appropriately determined, depending on the types of rubber materials or foamed bodies to be used and compositions of rubber materials. Alternatively, another method is that in which the shaft core 5*e* is allowed to penetrate through commercially available block-shaped foam, fixed by use of an adhesive or the like, and formed into a roller shape by a cutting process. Further, where the roller is constituted with a plurality of layers, there is available a method for winding a foam sheet to be used as a second layer around the surface of a roller manufactured by the above-described method to fix by use of an adhesive or a method for foaming and curing foam material after being applied on the roller surface layer.

Preparation of Second Elastic Layer

There is no particular restriction on elastic foams used in the second elastic layer 5*f*, and any elastic foam can be appropriately selected. These include, for example, ester-based polyurethane foam, ether-based polyurethane foam, and foam based on rubber materials such as nitrile rubber, ethylene propylene rubber, ethylene propylene diene rubber, styrene butadiene rubber, butadiene rubber, isoprene rubber, natural rubber, silicone rubber, acrylic rubber, chloroprene rubber, butyl rubber, and epichlor hydrine rubber. They may be used solely or in combination to give elastic foam. Particularly, preferable are ester-based polyurethane foam, ether-based polyurethane foam, nitrile rubber foam, ethylene propylene rubber foam, ethylene propylene diene rubber foam, and silicone rubber foam. Further, elastic foam may be prepared by mixing silicone oil with the foam material or coating silicone oil on the surface of the foam prepared in the above-described form for the purpose of controlling a frictional resistance coefficient.

An elastic body of the second elastic layer 5*f* can be prepared by use of a commercially available urethane foam. A stainless steel-made shaft core 5*e* having an outer diameter of 5 mm is passed through the center of a commercially available urethane foam block (12 mm×12 mm×300 mm), fixed by use of an adhesive and adjusted for the outer diameter by a cutting process, thereby forming a foam roller having the second elastic layer 5*f*.

Determination of Modulus of Repulsion Elasticity (JIS K 6400-3)

A test piece (50 mm×100 mm×100 mm or larger) is cut out from a product and a steel ball (16 mm in diameter and 16 g in weight) is dropped on the test piece from 500 mm above from the upper face of the test piece. A maximum height at which the ball has bounced back is given as a modulus of repulsion elasticity and expressed by percentage on the basis of the dropped height (500 mm). In the present invention, the modulus of repulsion elasticity is determined at room temperature (23° C.) and humidity of 65%.

Preparation of First Elastic Layer

Figure 8:
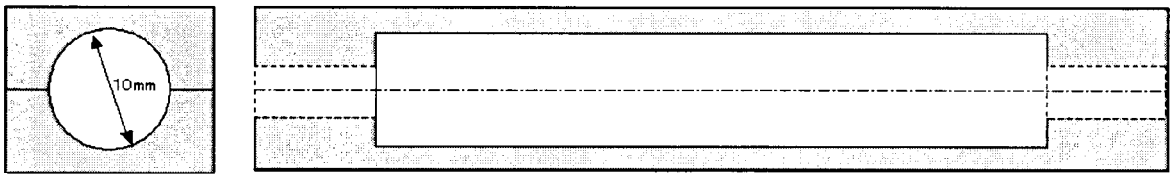
FIG. 8 is a schematic diagram showing molds for producing supply rollers used in Examples and Comparative Examples.

A mixture containing appropriate amounts of polyol foaming agent, isocyanate and catalyst is fed into a mold (refer to FIG. 8) in which a roller provided with the second elastic layer 5*f* has been fixed at a predetermined position, and cured at room temperature for 24 hours, thereby forming a first foamed elastic layer 5*g* on the second elastic layer 5*f*.

There is no particular restriction on polyols (a) used in preparing the first elastic layer 5*g*, and any polyol usually used in manufacturing urethane foam can be used. The polyol is appropriately selected such that the obtained urethane foam can be given at least one glass transition point at the respective temperature ranges of −70° C. to −20° C. and 0° C. to 60° C.

It is preferable that the polyol (a) be at least one member selected from the group consisting of polyoxyalkylene polyols, vinyl polymer-containing polyoxyalkylene polyols and polyester polyols.

The polyoxyalkylene polyols include those in which alkylene oxide is added to an initiator such as water, alcohols, amines and ammonia. Alcohols as an initiator include monovalent or polyvalent alcohols, for example, monovalent alcohols such as methanol and ethanol; divalent alcohols such as ethylene glycol and propylene glycol; trivalent alcohols such as glycerin, trimethyrol propane; tetravalent alcohols such as pentaerythritol; hexavalent alcohols such as sorbitol; and octavalent alcohols such as sucrose. Further, amines as an initiator include monovalent and polyvalent amines, for example, monovalent amines such as dimethyl amine and diethyl amine; divalent amines such as methyl amine and ethyl amine; trivalent amines such as monoethanol amine, diethanol amine and triethanol amine; tetravalent amines such as ethylene diamine; pentavalent amines such as diethylene triamine. Of these initiators, monovalent or hexavalent alcohols and monovalent or pentavalent amines are particularly preferable.

The alkylene oxides include, for example, ethylene oxide, propylene oxide, 1,2-, 1,3-, 1,4- and 2,3-butylene oxide or a combination. Of these compounds, preferable are propylene oxide and/or ethylene oxide. When they are used in combination, either of block or random addition is acceptable. The block addition is preferable.

The vinyl polymer-containing polyoxyalkylene polyols include the above-described polyoxyalkylene polyols in which vinyl monomers such as acrylonitrile and styrene are polymerized and dispersed stably in the presence of radicals. It is preferable that vinyl polymer be contained in polyoxyalkylene polyol from 15% by mass to 45% by mass.

The polyester polyols include, for example, those obtained through condensation polymerization of one type or two or more types of compounds having two or more hydroxyl groups such as ethylene glycol diethylene glycol, triethylene glycol 1,2-propylene glycol trimethylene glycol 1,3-butylene glycol 1,4-butylene glycol, hexamethylene glycol decamethylene glycol glycerine, trimethyrol propane, pentaerythritol and sorbitol with, for example, one type or two or more types of compounds having two or more of carboxyl groups such as adipic acid, succinic acid, malonic acid, maleic acid, tartaric acid, pimelic acid, sebacic acid, phthalic acid, terephthalic acid, isophthalic acid and trimellitic acid, or those obtained through ring-opening polymerization of ε-caprolactone.

It is preferable that polyols (a) used in preparing the first elastic layer 5*g* contain a polyol (a-1) having an average number of functional group numbers of 1.5 to 4.5 and a hydroxyl value of 20 to 70 mg KOH/g, preferably a hydroxyl value of 30 to 60 mg KOH/g, and a polyol (a-2) having an average number of functional groups of 1.5 to 4.5 and a hydroxyl value of 140 to 300 mg KOH/g, preferably a hydroxyl value of 200 to 270 mg KOH/g. Where the average functional group number is less than 1.5, a great decrease in physical properties such as dry heat permanent set of the thus obtained urethane foam is found. Where the average functional group number exceeds 4.5, the thus obtained urethane foam is decreased in elongation but increased in hardness, which may result in a decrease in physical properties such as tensile strength. Further, a polyol (a-1) (20 to 70 mg KOH/g) and a polyol (a-2) (140 to 300 mg KOH/g) mutually different in hydroxyl value are allowed to be contained, by which the thus obtained urethane foam is easily given a glass transition point at the respective temperature ranges of −70° C. to −20° C. and 0° C. to 60° C.

There is no particular restriction on polyisocyanates (b) used in preparing the first elastic layer 5*g*, and any known polyisocyanates usually used in producing a urethane foam can be used. The above polyisocyanates include, for example, aromatic polyisocyanates such as 2,4- or 2,6-tolylene diisocyanate (toluene diisocyanate: TDI), diphenyl methane diisocyanate (MDI), phenylene diisocyanate (PDI), napththalene diisocyanate (NDI); aromatic/aliphatic polyisocyanates such as 1,3- or 1,4-xylylene diisocyanate (XDI); aliphatic polyisocyanates such as hexamethylene diisocyanate (HDI); alicyclic polyisocyanates such as 3-isocyanate methyl-3,5,5-trimethylcyclohexyl isocyanate (IPDI), 4,4'-methylene bis (cyclohexyl isocyanate) ($H_{12}$MDI), 1,3- or 1,4-bis (isocyanate methyl) cyclohexane ($H_6$XDI), or carbodiimide modified substances, biuret modified substances, allophanate modified substances, dimers, and trimers of these polyisocyanates, or polymethylene polyphenyl polyisocyanates (crude MDI, polymeric MDI). They may be used solely or in combination. Of these compounds, preferable are aromatic polyisocyanates and particularly preferable is TDI.

There is no particular restriction on catalysts (c) used in preparing the first elastic layer 5*g*, and any known catalysts usually used in producing urethane foam may be used. These catalysts include, for example, tertiary amines such as triethyl amine, triethylene diamine, N-methyl morpholine; quaternary ammonium salts such as tetraethyl hydroxylammonium; amine-based catalysts of imidazoles such as imidazole and 2-ethyl-4-methyl imidazole; organic tin compounds such as tin acetate, tin octylate, dibutyl tin dilaurate, dibutyl tin chloride; organic lead compounds such as lead octylate, lead naphthenate; organic metal-based catalysts of organic nickel compounds such as nickel naphthenate. Of these catalysts, it is preferable to use an amine-based catalyst together with an organic metal-based catalyst. It is particularly preferable to use a tertiary amine together with an organic tin compound. The foaming property is improved with an increase in addition of the amine-based catalyst, thereby providing bubble-abundant foam. On the other hand, resin is increased in hardness with an increase in addition of an organic tin compound. In the present invention, in order to adjust the modulus of repulsion elasticity (%) of the foam, amine-based catalysts and organic metal-based catalysts are formulated in different proportions.

There is no particular restriction on foaming agents (d) used in preparing the first elastic layer 5*g*, and any known foaming agents usually used in producing urethane foams may be used. These foaming agents include, for example, water and/or halogen-substituted aliphatic hydrocarbon-based foaming agents such as trichloro fluoromethane, dichloro difluoromethane, trichloro ethane, trichloro ethylene, tetrachloro ethylene, methylene chloride, trichloro trifluoroethane, dibromo tetrafluoroethane and carbon tetrachloride. These foaming agents may be used in combination. It is, however, preferable that water is used solely in the present invention.

Elastic foams used for preparation of the first elastic layer 5*g* may include a conductive one, and a foamed elastic material in which a conductive agent is added to an appropriate elastic foam to impart conductivity is used as a conductive foamed elastic layer.

The conductive agent added in imparting the conductivity to an elastic foam includes an ion conductive agent and an electron conductive agent. The ion conductive agent includes, for example, ammonium salts including perchlorates such as tetraethyl ammonium, tetrabutyl ammonium, dodecyl trimethyl ammonium (e.g., lauryl trimethyl ammonium), hexadecyl trimethyl ammonium, octaldecyl trimethyl ammonium (e.g., stearyl trimethyl ammonium), modified fatty acid dimethyethyl ammonium; chlorate, hydrochloride, bromate, iodate, hydrofluoboric acid, sulfate, ethyl sulfate, carboxylate, sulfonate; alkaline metals such as lithiium, sodium, potassium, calcium, magnesium; and alkaline earth metals such as perchlorate, chlorate, hydrochloride, bromate, iodate, hydrofluoboric acid, trifluoromethyl sulfate, sulfonate.

Further, the electron conductive agent includes, for example, conductive carbon such as Ketien Black, acetylene black; rubber carbon such as SAF, ISAF, HAF, FEF, GPF, SRF, FT, and MT; acid-treated ink carbon, pyrolytic carbon, natural graphite, artificial graphite; conductive metal oxides such as tin oxide, titanium oxide, and zinc oxide; metals such as nickel, copper, silver, and germanium. These conductive agents may be used solely or in combination.

There is no particular restriction on addition of the conductive agents, and they may be added in any appropriately selected quantity, depending on the intended use. The ion conductive agent is added preferably from 0.01 parts by mass to 5 parts by mass with respect to of 100 parts of elastic foam by mass and more preferably from 0.05 parts by mass to 2 parts by mass. The electron conductive agent is added preferably from 1 part by mass to 50 parts by mass with respect to 100 parts by mass of elastic foam and more preferably from 5 parts by mass to 40 parts by mass. In addition, any known filling agents, cross-linking agents and other rubber additive agents may be added, whenever necessary, to the conductive foamed elastic layer, in addition to the conductive agent.

Further, the urethane foam composition of the present invention may contain a resistance adjusting agent, foam stabilizer, fire retardant and other agents at any appropriate quantity, whenever necessary, in addition to the above-described compositions.

Still further, the first elastic layer 5*g* may be prepared using the same material as the second elastic layer 5*f* in a different proportion.

According to the present invention, a developer supply roller and an image forming apparatus using the developer supply roller can be provided by adopting the developer supply roller capable of solving conventional problems and composed of at least two layers with different repulsion properties, wherein the first elastic layer (uppermost layer) that contacts the developing roller is made of low repulsion material and the second elastic layer is made of high repulsion elastic body, so that it is made possible to attain at the same time excellent toner scraping property and the reduction and stability of torque.

EXAMPLES

Hereinafter, Examples of the present invention will be described. However, the present invention shall not be limited to these Examples in any way.

Examples 1 to 8

In the following Examples, a description is given specifically for a developer supply roller 5*b* composed of a shaft core 5*e* as shown in FIG. 7 and two layers, that is, the first elastic layer 5*g*, which is the first layer from the surface side (hereinafter simply referred to as a "first layer"), the second elastic layer 5*f* which is the second layer from the surface side (hereinafter simply referred to as a "second layer").

The second layer was prepared by using commercially-available urethane foam with modulus of repulsion elasticity of 25%, 35% or 45%. A stainless steel-made core metal with an outer diameter of 5 mm was passed through the center of each of these commercially-available urethane foam blocks (12 mm×12 mm×300 mm), fixed by use of an adhesive and adjusted so as to give an outer diameter of 8 mm (the second layer was 1.5 mm in thickness) by a cutting process, thereby preparing foam rollers having the second layer to be used in the following Examples 1 to 8. Then, the first layers were respectively formed on the second layers with the following method and cut to have an outer diameter of 10 mm (the first layer was 1 mm in thickness), thereby preparing urethane foam rollers (developer supply rollers).

<Preparation of Low Repulsion/Elastic Foam>

To conduct the present invention, low repulsion/elastic foam was prepared.

A description is given of a method for preparing an elastic body, which is to be deposited on the second layer as the first layer, by listing the following materials.

<<Polyols (a)>>

(I) Polyoxyalkylene polyol: average number of functional groups=about 3, hydroxyl value=37 mgKOH/g, oxypropylene content in oxyalkylene portion=100% by mass (II) Polyoxyalkylene polyol: average number of functional groups=about 3, hydroxyl value=164 mgKOH/g, oxypropylene content in oxyalkylene portion=75% by mass, oxyethylene content=25% by mass (III) Polyoxyalkylene polyol: average number of functional groups=about 4, hydroxyl value=170 mgKOH/g, oxypropylene content in oxyalkylene portion=70% by mass, oxyethylene content=30% by mass <<Polyisocyanate (b)>>

Toluene diisocyanate (mixture of 2,4-isomer, 80% by mass, with 2,6-isomer, 20% by mass) (Takenate T-80 made by Takeda Pharmaceutical Company Limited)

<<Catalysts (c)>>

(I) Bis(2-dimethyl amino ethyl)ether/dipropylene glycol (70% solution) (NIAX A-1 made by Witoco Corporation)

(II) Tin octylate (Dabuco T-9 made by Airproducts and Chemicals Inc.)

<<Foaming Agent (d)>>

Water (Ion Exchanged Water)

<<Foam Stabilizer (f)>>

Siloxane oxyalkylene block copolymer-based foam stabilizer (F-242T made by Shin-Etsu Chemical Co., Ltd.)

40 parts by mass of polyol (I), 15 parts by mass of polyol (II), 45 parts by mass of polyol (III), 1.5 parts by mass of water, 1 part by mass of a foam stabilizer and 5 parts by mass of carbon black (conductive agent), were mixed and stirred with an electric mixer. Thereafter, catalyst (I) and catalyst (II) were added in the proportions shown in Table 1, and stirred for 5 seconds, and 32.9 parts by mass of polyisocyanate was immediately mixed therewith and stirred. The thus obtained urethane foam material was cast into a mold shown in FIG. 8 in which a stainless steel-made core metal having an outer diameter of 5 mm was arranged, and allowed to stand at room temperature for 24 hours for curing, thereby preparing a urethane foam roller (developer supply roller) with an outer diameter of 10 mm, in which an elastic foam layer made up of the first and the second layers was laminated. The above-described urethane foam was also cast into a mold (100 mm×100 mm×100 mm), and allowed to stand for 24 hours for curing, which was given as a test piece. The test piece was determined for the modulus of repulsion elasticity (%), the result of which is shown in Table 1.

Determination of Modulus of Repulsion Elasticity (JIS K 6400-3)

A steel ball (16 mm in diameter and 16 g in weight) was dropped on the test piece from 500 mm above from the upper face of the test piece. A maximum height at which the ball bounced back was given as a modulus of repulsion elasticity and expressed by percentage on the basis of the dropped height (500 mm). In the present invention, the modulus of repulsion elasticity was determined at room temperature (23° C.) and relative humidity of 65%.

TABLE 1

| | First layer | | | |
|---|---|---|---|---|
| | Catalyst (I) Bis (2-dimethyl amino ethyl) ether/ dipropylene glycol (70% solution) (NIAX A-1 made by Witoco Corporation) | Catalyst (II) Tin octylate (Dabuco T-9 made by Airproducts and Chemicals Inc.) | Modulus of repulsion elasticity (%) k1 | Second layer Modulus of repulsion elasticity (%) k2 |
| Example 1 | 0.3 | 0.05 | 2 | 25 |
| Example 2 | 0.3 | 0.1 | 8 | 25 |
| Example 3 | 0.3 | 0.2 | 14 | 25 |
| Example 4 | 0.3 | 0.1 | 8 | 35 |
| Example 5 | 0.3 | 0.2 | 14 | 35 |
| Example 6 | 0.3 | 0.05 | 2 | 45 |
| Example 7 | 0.3 | 0.1 | 8 | 45 |
| Example 8 | 0.3 | 0.2 | 14 | 45 |

The thus prepared urethane foam rollers (developer supply rollers) of Examples 1 to 8 were used for image formation, followed confirmation of their effects. In anticipation of image formation, the developing cartridge of the commercially available dry-type printer using one-component development process (LP-1500C made by Seiko Epson Corporation) was modified in such a way that the rotational speed of the rollers can be altered by an external drive motor, so that the indentation amount of the supply rollers used in Examples 1 to 8 into a developing roller, the rotational number and the rotational direction can be optionally set. In the printer, the indentation amount P of the supply roller into the developing roller was set to 0.8 mm (P/t=0.8, where t represents the thickness of the first elastic layer of the supply roller and is 1 mm), the supply roller was rotated in a counter direction with respect to the developing roller at rotational number of 300 rpm, 100% black solid images were output, and evaluation was made as follows for initial images (1 to 100 sheets) and endurance images (10,000 sheets). The results are shown in Table 4.

In the evaluation of the initial images, a state free from any image irregularities or thin spots at a solid portion was evaluated as A, a state having either of image irregularities or thin spots as B and a state having both of them, as C.

In the evaluation of the endurance images, a state completely free from any streaks at a solid portion was evaluated as A, a state having two or three streaks as B, and a state having four or more streaks as C.

Comparative Examples 1 to 5

Developer supply rollers each composed of the first layer having a modulus of repulsion elasticity k1 and the second layer having a modulus of repulsion elasticity k2 shown in Table 2 were prepared as in Examples 1 to 8. Note that the supply rollers of Comparative Examples 1 to 5 were adjusted such that they have an outer diameter of 10 mm, as in Examples 1 to 8.

TABLE 2

| | First layer Modulus of repulsion elasticity (%) k1 | Second layer Modulus of repulsion elasticity (%) k2 |
|---|---|---|
| Comparative Example 1 | 8 | 8 |
| Comparative Example 2 | 8 | 14 |
| Comparative Example 3 | 25 | 35 |
| Comparative Example 4 | 35 | 14 |
| Comparative Example 5 | 35 | 35 |

The developer supply roller of Comparative example 1 was prepared similarly as in Example 1 to Example 8 in such a manner that the first layer and the second layer were both 8% in modulus of repulsion elasticity.

More specifically, 40 parts by mass of polyol (I), 15 parts by mass of polyol (II), 45 parts by mass of polyol (III), 1.5 parts by mass of water, 1 part by mass of a foam stabilizer and 5 parts by mass of carbon black (conductive agent) were mixed and stirred by using an electric mixer. Thereafter, catalyst (I) and catalyst (II) were added in proportions shown in Table 3, and stirred for 5 seconds, and 32.9 parts by mass of polyisocyanate was immediately mixed therewith and stirred. The thus obtained urethane foam was cast into a mold shown in FIG. 8 in which a stainless steel-made core metal having an outer diameter of 5 mm was arranged, and allowed to stand at room temperature for 24 hours for curing, thereby preparing urethane foam rollers (developer supply rollers) with an outer diameter of 10 mm, in which the first layer was 1.25 mm in thickness and the second layer was 1.25 mm in thickness, with a total thickness of 2.5 mm. The above-described urethane foam was also cast into a mold (100 mm×100 mm×100 mm), and allowed to stand for 24 hours for curing, which was given as a test piece. The test piece was determined for the modulus of repulsion elasticity (%) as in Examples 1 to 8. The results are shown in Table 3.

The elastic bodies of the second elastic layer in the developer supply rollers of Comparative Examples 2 to 5 was prepared by use of commercially available urethane foams with the modulus of repulsion elasticity of 14% or 35%. A stainless steel-made shaft core having an outer diameter of 5 mm was allowed to penetrate through the center of the commercially available urethane foam block (12 mm×12 mm×300 mm), fixed by use of an adhesive, adjusted for an outer diameter by a cutting process so as to give 8.0 mm in outer diameter (the second layer was 1.5 mm in thickness), thereby forming a urethane foam roller having the second layer to be used in Comparative Examples 2 to 5.

In Comparative Example 2, the first layer was formed as in Examples 1 to 8. More specifically, 40 parts by mass of polyol (I), 15 parts by mass of polyol (II), 45 parts by mass of polyol (III), 1.5 parts by mass of water, 1 part by mass of a foam stabilizer and 5 parts by mass of carbon black (conductive agent) were mixed and stirred with an electric mixer. Thereafter, catalyst (I) and catalyst (II) were added in proportions shown in Table 3, and stirred for 5 seconds, and 32.9 parts by mass of polyisocyanate was immediately mixed therewith and stirred. The thus obtained urethane foam was cast into a mold and allowed to stand at room temperature for 24 hours for curing, thereby preparing a urethane foam roller (developer supply roller) with an outer diameter of 10 mm after the first layer was laminated (the first layer was 1 mm in thickness). The above-described urethane foam was also cast into a mold (100 mm×100 mm×100 mm) and allowed to stand for 24 hours for curing to provide a test piece. The test piece was determined for the modulus of repulsion elasticity (%) as in Examples 1 to 8. The results are shown in Table 3.

TABLE 3

| | First and second layers | | |
|---|---|---|---|
| | Catalyst (I) Bis (2-dimethyl amino ethyl) ether/ dipropylene glycol (70% solution) (NIAX A-1 made by Witoco Corporation) | Catalyst (II) Tin octylate (Dabuco T-9 made by Airproducts and Chemicals Inc.) | Modulus of repulsion elasticity (%) k1 |
| Comparative Example 1 | 0.3 | 0.1 | 8 |
| | First layer | | |
| | Catalyst (I) Bis (2-dimethyl amino ethyl) ether/ dipropylene glycol (70% solution) (NIAX A-1 made by Witoco Corporation) | Catalyst (II) Tin octylate (Dabuco T-9 made by Airproducts and Chemicals Inc.) | Modulus of repulsion elasticity (%) k1 |
| Comparative Example 2 | 0.3 | 0.1 | 8 |

In Comparative Examples 3 to 5, commercially available urethane foams with a thickness of 1 mm and modulus of repulsion elasticity of 25% or 35% were produced as the first layer on the respective second layers, thereby preparing foam rollers (developer supply rollers).

The thus prepared urethane foam rollers (developer supply rollers) in Comparative Examples 1 to 5 were used as in Examples 1 to 8 to output 100% solid images by using a commercially available printer, which had been modified as described above. Evaluation was made for initial images (1 to 100 sheets) and endurance images (10,000 sheets). The results are shown in Table 4.

TABLE 4

| | Initial image | Endurance image |
|---|---|---|
| Example 1 | A | A |
| Example 2 | A | A |
| Example 3 | A | A |
| Example 4 | A | A |
| Example 5 | A | A |
| Example 6 | A | A |
| Example 7 | A | A |
| Example 8 | A | A |
| Comparative Example 1 | C | C |
| Comparative Example 2 | B | B |
| Comparative Example 3 | A | B |
| Comparative Example 4 | A | C |
| Comparative Example 5 | A | C |

It is apparent from the results of Table 4 that the initial images or endurance images in Examples 1 to 8 are not influenced at all with regard to quality such as image density and image unevenness and kept high in quality. On the other hand, the initial images and endurance images in Comparative Examples 1 to 5 have problems with regard to quality, that is, it was established that the image density or image unevenness failed to be kept high in quality.

What is claimed is:

1. A developer supply roller comprising:

a shaft core; and an elastic layer over the shaft core, wherein the elastic layer is composed of at least a first elastic layer and a second elastic layer, the first elastic layer and second elastic layer made of elastic bodies with different moduli of elasticity, the first layer being an outermost layer of the supply roller, and wherein the relationships $0\% \leqq k1 \leqq 20\%$ and $20\% \leqq k2 \leqq 70\%$ are satisfied, where k1 is the modulus of repulsion elasticity of the first elastic layer and k2 is the modulus of repulsion elasticity (%) of the second elastic layer.

2. The developer supply roller according to claim 1, wherein the first elastic layer is made of foam.

3. The developer supply roller according to claim 1, wherein the first elastic layer is 0.2 mm to 2.0 mm in thickness.

4. An image forming apparatus comprising:

a latent image bearing member;

a charging unit configured to charging a surface of the latent image bearing member;

an exposure unit configured to exposing the surface of the latent image bearing member to form a latent electrostatic image thereon; and a developing unit that comprises a toner container portion structured so as to supply a new toner, a developer supply roller and a developing roller, the supply roller being in contact with the developing roller, the developing unit configured to retain the toner contained in the toner container portion on a surface of the supply roller and rotate the supply roller so as to transfer the toner onto the developing roller to thereby form a toner thin layer, wherein the developer supply roller comprises: a shaft core; and an elastic layer over the shaft core, wherein the elastic layer is composed of at least a first elastic layer and a second elastic layer, the first elastic layer and second elastic layer made of elastic bodies with different moduli of elasticity, the first layer being an outermost layer of the supply roller, wherein the relationships $0\% \leqq k1 \leqq 20\%$ and $20\% \leqq k2 \leqq 70\%$ are satisfied, where k1 is the modulus of repulsion elasticity of the first elastic layer and k2 is the modulus of repulsion elasticity (%) of the second elastic layer, and wherein the thickness t (mm) of the first elastic layer of the developer supply roller is in a range of $0.2\ \text{mm} \leqq t \leqq 2.0$ mm, and the indentation amount P (mm) of the supply roller into the developing roller satisfies the relationship $0.2 \leqq P/t \leqq 1$.

5. The image forming apparatus according to claim 4, wherein the developing roller and the developer supply roller are rotated in opposite directions at a nip portion.

6. The image forming apparatus according to claim 4, wherein the developer supply roller is 6 mm to 12 mm in outer diameter.

7. The image forming apparatus according to claim 4, wherein the toner is a non-magnetic one component developing toner.

* * * * *